US009715771B2

(12) United States Patent
Gregg et al.

(10) Patent No.: US 9,715,771 B2
(45) Date of Patent: Jul. 25, 2017

(54) TRIP MANAGEMENT SYSTEM AND METHOD FOR A VEHICLE

(75) Inventors: Christopher Gregg, Gardena, CA (US); Nicholas S. Sitarski, Ypsilanti, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 335 days.

(21) Appl. No.: 13/585,647

(22) Filed: Aug. 14, 2012

(65) Prior Publication Data

US 2013/0274993 A1 Oct. 17, 2013

Related U.S. Application Data

(60) Provisional application No. 61/624,007, filed on Apr. 13, 2012.

(51) Int. Cl.
*G07C 5/08* (2006.01)

(52) U.S. Cl.
CPC ..... *G07C 5/085* (2013.01)

(58) Field of Classification Search
CPC ..... G01C 21/20; G01C 21/165; G07C 5/085
See application file for complete search history.

(56) References Cited

U.S. PATENT DOCUMENTS

| | | | |
|---|---|---|---|
| 3,983,372 | A | 9/1976 | Klaver |
| 6,111,498 | A | 8/2000 | Jobes et al. |
| 6,278,921 | B1 | 8/2001 | Harrison et al. |
| 6,691,025 | B2 | 2/2004 | Reimer |
| 6,988,033 | B1 | 1/2006 | Lowrey et al. |
| 7,512,486 | B2 | 3/2009 | Needham et al. |
| 7,889,063 | B2 | 2/2011 | Rovik et al. |
| 7,954,579 | B2 | 6/2011 | Rodriguez et al. |
| 8,099,208 | B2 | 1/2012 | Tauchi et al. |
| 2004/0008109 | A1 | 1/2004 | Endoh |
| 2004/0093155 | A1 | 5/2004 | Simonds et al. |
| 2006/0200309 | A1 * | 9/2006 | Yu et al. ..... 701/208 |

(Continued)

FOREIGN PATENT DOCUMENTS

| | | |
|---|---|---|
| EP | 2343208 | 7/2011 |
| JP | 58-020538 | 2/1983 |

(Continued)

*Primary Examiner* — Basil T Jos
(74) *Attorney, Agent, or Firm* — Snell & Wilmer LLP

(57) ABSTRACT

A trip data management and display system for a vehicle. The system includes a processor, a memory, a user-interface and a display. During a trip traveled by the vehicle, the processor receives data from one or more systems or components. The processor receives input via the user-interface to associate a category and a filename with the received data for storage in the memory. The stored data may then be retrieved for display upon the display of the vehicle. The trip traveled by the vehicle is predefined according to user-settable parameters or is automatically determined based on vehicle characteristics. Instantaneous data corresponding to a trip currently being traveled by the vehicle may also be displayed on the display adjacent to the stored data from memory. The data stored may be managed by a user to associate it with different or multiple categories or to delete particular stored data.

19 Claims, 5 Drawing Sheets

(56) References Cited

U.S. PATENT DOCUMENTS

| | | | | |
|---|---|---|---|---|
| 2007/0106468 | A1* | 5/2007 | Eichenbaum | G01C 21/343 701/431 |
| 2008/0125958 | A1 | 5/2008 | Boss et al. | |
| 2010/0063721 | A1* | 3/2010 | Won | G01C 21/343 701/533 |
| 2010/0318293 | A1* | 12/2010 | Brush et al. | 701/211 |
| 2011/0112717 | A1 | 5/2011 | Resner | |
| 2011/0118976 | A1* | 5/2011 | Harding | G01C 21/3679 701/533 |
| 2011/0153175 | A1 | 6/2011 | Zhang et al. | |
| 2011/0205044 | A1* | 8/2011 | Enomoto et al. | 340/439 |
| 2011/0238257 | A1 | 9/2011 | Tarnowsky et al. | |
| 2011/0251782 | A1 | 10/2011 | Perkins et al. | |
| 2011/0264317 | A1 | 10/2011 | Druenert et al. | |
| 2012/0130630 | A1* | 5/2012 | Tang et al. | 701/413 |

FOREIGN PATENT DOCUMENTS

| | | |
|---|---|---|
| JP | 11-064171 | 3/1999 |
| JP | 2003-331380 | 11/2003 |
| JP | 2004-045180 | 2/2004 |
| JP | 2006-003147 | 1/2006 |
| JP | 2009-129074 | 6/2009 |
| JP | 2010-083276 | 4/2010 |
| JP | 2011-117838 | 6/2011 |
| KR | 10-0591043 | 6/2006 |

* cited by examiner

TRIP MANAGEMENT SYSTEM AND METHOD FOR A VEHICLE

CROSS REFERENCE TO RELATED APPLICATIONS

This application claims the benefit and priority of U.S. Provisional Application No. 61/624,007, filed on Apr. 13, 2012, the entire contents of which are hereby incorporated by reference herein.

BACKGROUND

1. Field

The present invention relates generally to data management systems and improvements thereof. More particularly, the present invention relates to travel or trip data management systems and methods for use in an automobile or other vehicle and improvements thereof.

2. Description of the Related Art

As vehicle systems become increasingly computerized and electronically controlled, vehicle performance and driving characteristics have become progressively more obscured from the drivers operating them. For example, performance tuning and other operational features for such vehicles are now difficult for the average consumer to understand and tweak or modify since underlying software or electronic-based systems can significantly impact these processes. Many times, only enthusiasts with compatible computer hardware and software are able to interpret and understand the specific settings (e.g., fuel maps, etc.) or characteristics of an automobile in order to modify vehicle parameters and to merely gain additional insight on efficient manners for operating the vehicle. Further exacerbating this issue is the recent increase in popularity of hybrid vehicles or other alternative fuel source vehicles with complex interrelationships among a variety of onboard vehicle systems.

Automobile consumers are also becoming increasingly more cost-conscious when purchasing vehicles, particularly in regards to fuel or energy efficiency, due in large part to the rapidly growing cost of vehicle fuel. Similarly, many drivers are becoming more interested in maximizing their distance traveled at a minimum of fuel consumed, but oftentimes have limited manners in which to modify or ascertain efficient driving habits to achieve such goals. Even outside the realm of fuel efficiency, automobile drivers appreciate feedback on vehicle performance without requiring extensive knowledge about the vehicle systems or manual and time-consuming calculations based on available vehicle data. A system or method for storing vehicle data that can be easily and simply provided to users of automobiles or other vehicles would thus be desired.

Ideally, such a system or method would be inexpensive to manufacture and integrate with systems or components of the vehicle. In addition, such a system or method would ideally allow for a variety of performance or other vehicle characteristics to be shared with the user of the vehicle. The system or method would ideally be flexible to allow users the ability to customize or manipulate data or statistical information to only that information desired by that particular user. Moreover, since such performance or other vehicle characteristics can be skewed as a result of limited data sets, resulting in information that may be unreliable, such a system or method would ideally be capable of discerning which data should be used for particular user showcases or statistic generation such that users are not presented with inaccurate or misleading information.

SUMMARY

A system or method for managing and/or displaying data or statistical information relating to a vehicle or automobile is described. In one embodiment, a method for managing data of a vehicle may include the steps of acquiring, using a processor of the vehicle, trip data corresponding to the vehicle, determining, using the processor, a category for the trip data, determining, using the processor, a filename for the trip data, storing the trip data in a memory of the vehicle, the stored trip data associated with the category and the filename, determining, using the processor, a viewing format for information based on at least a portion of the trip data, and displaying the information on a display of the vehicle in the viewing format.

In another embodiment, a method for managing data corresponding to a vehicle may include the steps of receiving first trip data at a processor of the vehicle, the first trip data corresponding to at least one characteristic of the vehicle during a first trip made by the vehicle, storing the first trip data in a memory of the vehicle, associating, using the processor, a category with the first trip data, associating, using the processor, a filename with the first trip data, determining, using the processor, at least a portion of the first trip data to be displayed on a display of the vehicle, receiving second trip data at the processor, the second trip data corresponding to at least one characteristic of the vehicle during a second trip currently being made by the vehicle, and displaying the at least a portion of the first trip data and at least a portion of the second trip data adjacent to one another on a display of the vehicle.

In still another embodiment, a system for management of trip data for a vehicle may include a processor configured to receive data relating to the vehicle and assign a category and a filename to the received data. A memory is connected with the processor and configured to store the received data. A user-interface component is connected with the processor and is configured to be manipulated by a user of the vehicle. A display is connected with the processor and configured to display a statistic relating to the vehicle in a display format selected by the user of the vehicle via manipulation of the user-interface component, the statistic calculated by the processor based upon the received data.

In another embodiment, a method for automatically providing a filename for a second trip based on information collected from a first trip. The method includes enabling, using a processor of the vehicle, an on-board user-activated GPS feature for tracking a starting location and an ending location of a vehicle, and storing a first trip data in a memory of the vehicle, the first trip data corresponding to at least one characteristic of the vehicle during a first trip made by the vehicle. The method also includes determining, using the processor, a first category for the first trip data, determining, using the processor, a first filename for the first trip data, and automatically determining, using the processor, a second filename based on the starting location and the ending location of a second trip, the first category, and the first filename.

BRIEF DESCRIPTION OF THE DRAWINGS

Other systems, methods, features, and advantages of the present invention will be or will become apparent to one with skill in the art upon examination of the following figures and detailed description. It is intended that all such additional systems, methods, features, and advantages be included within this description, be within the scope of the present invention, and be protected by the accompanying claims. Component parts shown in the drawings are not necessarily to scale, and may be exaggerated to better illustrate the important features of the present invention. In the drawings, like reference numerals designate like parts throughout the different views, wherein:

DETAILED DESCRIPTION

Figure 1:
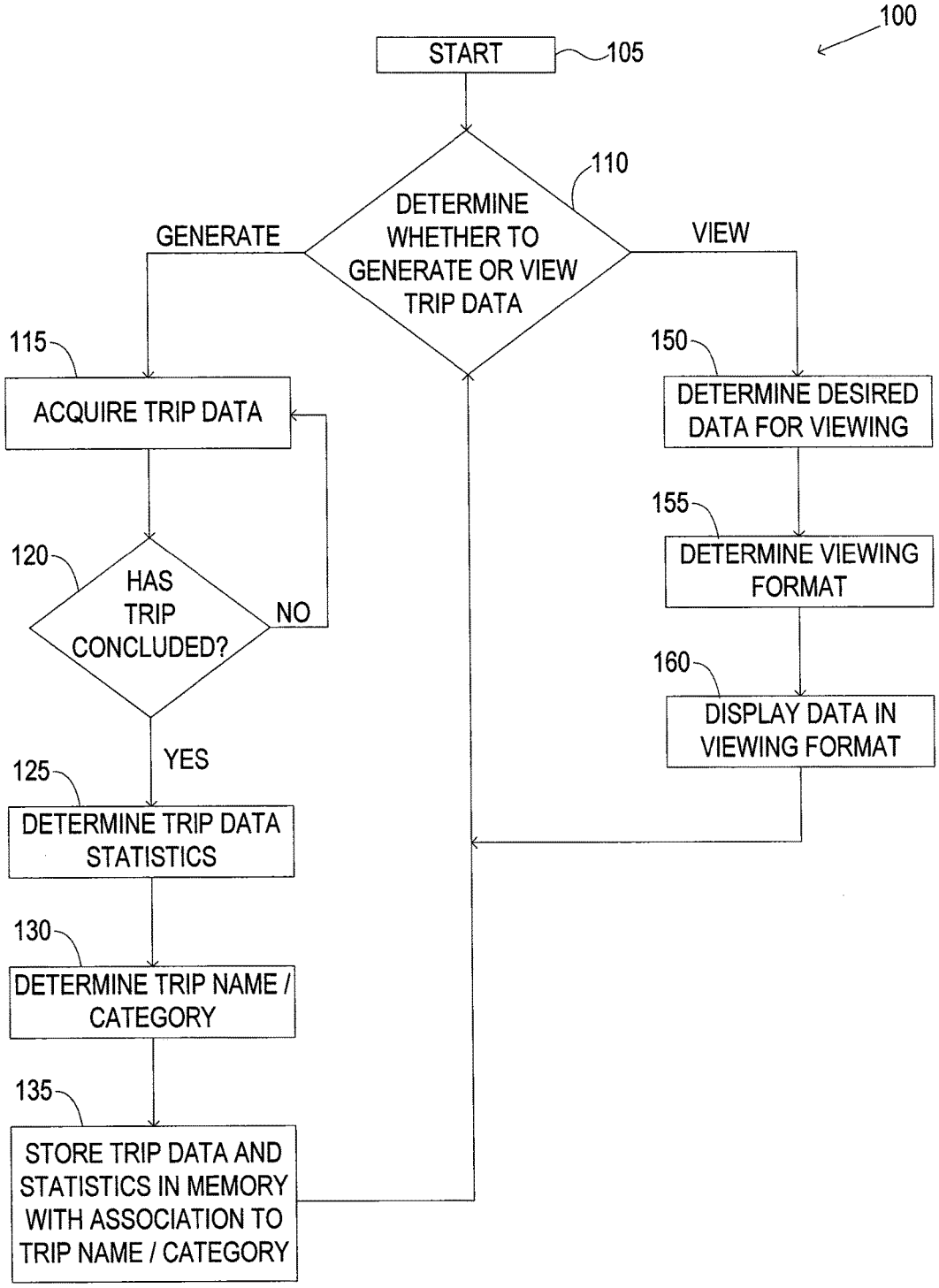
FIG. 1 is a flowchart of a trip management system for a vehicle according to an embodiment of the present invention.

Referring to FIG. 1, a logical flowchart for one embodiment of a trip management system 100 for a vehicle is shown. The steps or functionality of the trip management system 100 may be stored in a memory coupled to the vehicle and accessible by a processor coupled to the vehicle. The processor interfaces with the memory and executes software code providing the functional steps of the trip management system 100, as described in greater detail herein. The flowchart 100 begins at step 105. This may occur upon powering up of the vehicle (e.g., turning an ignition key or pressing a start-up button of the vehicle) or otherwise providing power to the electronic accessories of the vehicle.

In step 110, the trip management system 100 determines whether to operate in a trip data generation mode or a trip data viewing mode. This may involve querying a user of the vehicle via a message or indicator on a display within a cabin of the vehicle. The user may respond by interfacing with one or more components of the trip management system 100 (e.g., pressing a corresponding location of a touch-sensitive display, utilizing knobs or buttons, speaking to a microphone connected with voice-recognition software, etc.). Depending upon the user's response, the trip management system 100 will either begin data generation or data viewing, as discussed in greater detail herein. In certain embodiments, the trip management system 100 may be capable of both displaying trip data and generating trip data simultaneously. In an alternative embodiment, the trip management system 100 may automatically begin trip data generation or trip data viewing as a default mode upon start-up of the vehicle. In yet another alternative embodiment, the trip management system 100 may not generate trip data or display trip data, thus operating in an OFF or sleep mode. Such a mode may be desirable for a user of the vehicle who does not wish to store any data regarding a particular trip and does not wish to view trip data at that time.

If the trip management system 100 determines trip data generation is desired, operation proceeds to step 115. In step 115, the trip management system 100 operates by acquiring trip data for the vehicle. The trip management system 100 may interface with one or more sensors or other electronics coupled with the vehicle for determining a variety of vehicle characteristics. For example, the processor of the trip management system 100 may communicate with an engine control unit ("ECU") of the vehicle for acquiring the vehicle fuel efficiency (e.g., miles per gallon), speed, etc. as the vehicle travels from one location to another. Any of a variety of vehicle characteristics may be acquired by the trip management system 100 for a particular vehicle trip.

The acquisition of trip data in step 115 continues until the trip management system 100 determines that a particular trip for the vehicle has concluded. In step 120, if the trip management system 100 determines that the particular trip for the vehicle has not yet concluded, acquisition of trip data via step 115 continues. This may occur, for example, until a user indicates to the trip management system 100 that the vehicle has arrived at the desired destination, such as by pressing a trip reset button or by manipulating any of a variety of other user-interface components (e.g., an element of a touch screen display). In another example, if the vehicle is equipped with a navigation system or components, the trip management system 100 may automatically determine that the particular trip for the vehicle has concluded once the vehicle has arrived at a destination of the navigation system. In still another example, the trip management system 100 may automatically determine that the particular trip for the vehicle has concluded based on a characteristic of the vehicle, such as shutdown of the engine, removal of a key from an ignition switch, remaining in a parked position or gear for a predetermined period of time, etc.

The conclusion of the particular trip for the vehicle in step 120 may also be based upon one or more user-defined parameters. For example, the user may interface with the trip management system 100 to set a specific time period for the acquisition of trip data. Such acquisition may be useful for determining fuel efficiency (e.g., miles per gallon, miles per kilowatt-hour, kilometers per liter, etc.), maximum speed, maximum torque, distance traveled, etc., for example, at a drag strip or while on a dynamometer. A variety of user-defined parameters may be utilized or combined, for example, data acquisition may occur until a particular speed is obtained or a particular number of miles are traversed.

Once the trip management system 100 determines the particular vehicle trip has completed, operation continues to step 125 where the trip data acquired in step 115 is analyzed or otherwise utilized by the processor of the trip management system 100. In step 125, a variety of statistics or information regarding the trip data is determined. The processor of the trip management system 100 utilizes the trip data acquired in step 115 to determine such statistics or information. For example, this may include a maximum vehicle speed for the vehicle trip, an average miles-per-gallon value for the trip, an average vehicle speed for the vehicle trip, a maximum amount of torque or horsepower for a particular engine RPM, etc.

In step 130, the trip management system 100 determines a trip category and a trip name for the trip data acquired in step 115 and the trip statistics determined in step 125. In one embodiment, the trip category may be selected from among a plurality of predetermined categories or may be a newly generated category. In one example, the trip management system 100 may have already stored default categories titled "Work Trips," "Fun Trips," "Long Trips," and "Short Trips." In step 130, a user of the vehicle may select the category "Fun Trips" from a drop-down menu or other listing of available categories already stored in the memory of the trip management system 100 for the particular trip determined to be concluded in step 120. In certain embodiments, a user may be permitted to assign multiple categories to a single set of trip data. Categories may also have particular parameters assigned to them such that trip data meeting those particular parameters are automatically associated with such categories. For example, if a category titled "Short Trips" has a parameter defining a trip less than 10 miles, then acquired trip data for a trip less than 10 miles in length will be automatically associated with the category "Short Trips." Any of a variety of parameters may be established (e.g., time of day, day of week, particular user of the vehicle, etc).

The titles of the various categories for selection by a user may be predetermined and stored in the memory of the trip management system 100. The trip management system 100 may also allow the user of the vehicle to edit stored categories, delete certain categories or create new categories and title them as desired. For example, the trip management system 100 may not have any predetermined categories stored in the memory or may not have a particular category desired by the user. Thus, the user of the vehicle may instead interface with the trip management system 100 to create a new category (e.g., Trips to Grandparents House) and associate the trip data acquired in step 115 with the newly created category. In one embodiment, a default category may be determined or assigned for the trip data unless otherwise specified by the user of the vehicle. Such automatic categorizing provides increased ease-of-use for the user of the vehicle who would otherwise be required to manually categorize every set of acquired trip data.

In addition to determination of a trip category for the trip data, the trip management system 100 also determines a trip name for the set of trip data, since a particular category of trip data in the trip management system 100 may have a number of different sets of trip data associated with the category (e.g., there may be multiple different trips categorized as "short trips"). The trip management system 100 may use the trip data or the navigation system (i.e., the GPS data), the trip date and/or the time of day to determine or suggest an appropriate trip name. Example 1: Trip from user defined "home" to "work"="Morning Commute". Example 2: Trip from user defined "home" to input address="Home to <street, city>". Example 3: Driving at race track defined in the navigation system "<race track location>". Example 4: Aug. 1, 2012 Trip. The use of the GPS data is enabled by the user of the vehicle to respect privacy concerns. In one embodiment, a default name may be determined or assigned for the trip data unless otherwise determined by the trip management system 100 or specified by the user of the vehicle. This default name may automatically choose the category determined and append a sequentially assigned numeral to the end. Thus, each trip data assigned to a particular category would be automatically assigned a name with a different numeral (e.g., category1_trip1, category1_trip2, etc.) unless otherwise specified by the user of the vehicle. The default name can also be the date at the start of the trip. Such automatic naming or automatic determination provides increased ease-of-use for the user of the vehicle who would otherwise be required to manually assign names for every set of acquired trip data.

After a category and name is determined for the trip data, the trip data acquired in step 115 and any associated data statistics determined in step 125 is stored in the memory of the trip management system 100 in step 135 with association to the category and name. In an alternative embodiment, only the trip data acquired in step 115 may be stored in the memory in step 135 without any trip data statistics from step 125. For example, step 125 may be eliminated in an alternative embodiment and any statistics or information regarding a particular set of trip data stored in memory may be determined from the stored trip data just prior to viewing of the trip data, as discussed in greater detail herein. In one embodiment, the trip management system 100 may permit external access to the data stored in step 135 (e.g., via a USB or wireless interface) so that such data can be exported to a device separate from the vehicle, such as a personal computer or diagnostics system. This data may be exported in a variety of file formats, for example as plain text, as a spreadsheet, as a database, etc.

After storage with category and name association in step 135 is complete, operation returns to step 110 where the trip management system 100 may again determine whether generating new trip data or viewing of previously stored trip data is desired, as previously discussed. If the trip management system 100 determines that trip data viewing is desired, operation continues to step 150. The processor of the trip management system 100 may thus interface with the memory of the trip management system 100 in order to display all or a portion of trip data stored as part of the trip management system 100, as described in greater detail herein.

In step 150, the trip management system 100 determines the particular trip data desired for display to the user of the vehicle. This determination may be made by requiring user input, as discussed in greater detail herein, or may initially display default data to the user. The desired trip data may be data previously acquired in step 115 of the trip management system and/or trip data statistics determined in step 125 of the trip management system. In certain embodiments, the trip management system 100 may determine various trip data statistics based upon trip data acquired in step 115 at the time a user wishes to view the data instead of determining such statistics in step 125 and previously storing such statistics in step 135. In step 155, the trip management system 100 determines the viewing format for display of the desired trip data/statistics, for example, a bar graph, a numerical indicator, etc. In step 160, the trip management system 100 displays the trip data/statistics to the user of the vehicle based on the determined desired data for viewing in step 150 and the determined viewing format in step 155. The display may be any of a variety of appropriate viewing devices, for example, a liquid crystal display ("LCD") screen positioned in a dash compartment of the vehicle. The display may show only previously stored data on the display of the vehicle or may display both previously stored data and instantaneous (i.e. current) data for the vehicle adjacent or side-by-side with one another, as discussed in greater detail herein. After the user is done viewing the data, they may interface with the trip management system 100 in order to return operation to step 110.

Figure 2:
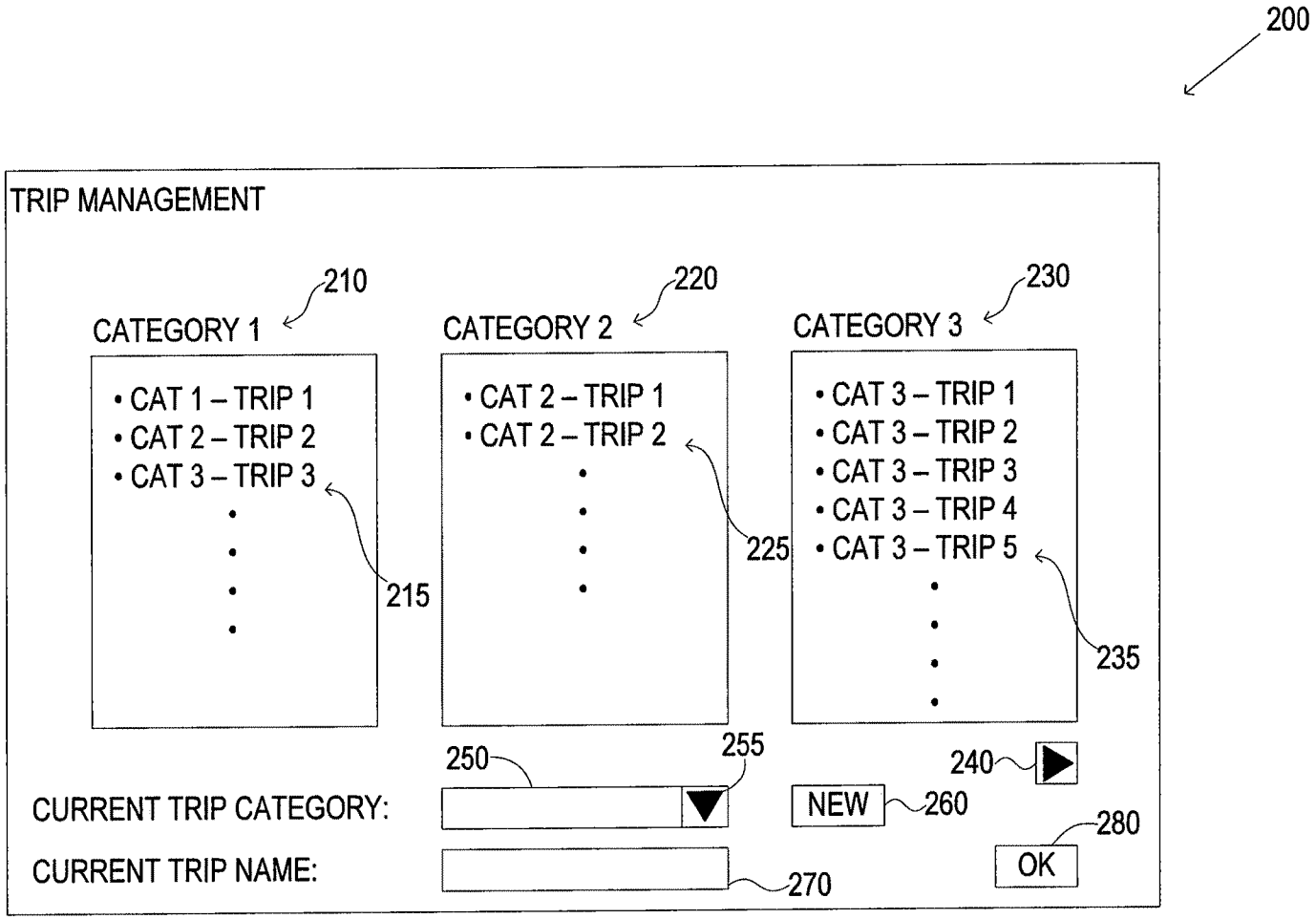
FIG. 2 is a management user-interface screen of a trip management system for a vehicle for categorizing trip data according to an embodiment of the present invention.

FIG. 2 shows one embodiment of a trip management screen of a trip management system 200 of a vehicle for categorizing trip data. The trip management screen may be displayed on a display within a cabin of the vehicle for allowing a user of the vehicle to categorize and name trip data of the vehicle. The trip management system 200 may be the same or similar to the trip management system 100 previously described for FIG. 1. A plurality of previously stored categories (210, 220, 230) is displayed on the trip management screen. For each of the plurality of previously stored categories (210, 220, 230), a plurality of trip data files (215, 225, 235) are associated therewith.

For example, for the first stored category 210, the trip data files 215 have been associated therewith. For the second stored category 220, the trip data files 225 have been associated therewith. For the third stored category 230, the trip data files 235 have been associated therewith. Any number of categories may be created and stored as part of the trip management system 200. Although only three stored categories (210, 220, 230) are shown on the screen in FIG. 2, greater or fewer categories may be shown to a user in an alternative embodiment. A button or control 240 is also shown on the screen for notifying or allowing a user to page between multiple screens showing any additional stored categories in the trip management system 200. In one embodiment, the most common or frequently utilized categories may be initially displayed on the screen. In another embodiment, the categories may be alternatively ordered (e.g., alphabetically, by creation date, by total number of trip data stored for each, etc.).

The trip management screen of the trip management system 200 also includes a category entry box 250 for allowing a user to type or otherwise select a trip category for a current set of trip data (e.g., trip data acquired in step 115 of FIG. 1). The user may also press or manipulate the drop-down indicator 255 and select a category that has already been previously stored in the trip management system 200 (e.g., the first category 210, the second category 220, the third category 230, etc.). If the user desires to generate a new category, pressing or operating on the new category indicator 260 allows the user to type a new category name into the category entry box 250 and save it in the trip management system 200.

In addition to selecting a category for a current set of trip data, the trip management screen of the trip management system 200 also includes a name entry box 270 for allowing a user to type a name for the particular set of trip data. In certain embodiments, the user may leave the name entry box 270 blank and the trip management system 200 will automatically define a name for the trip data, for example, as previously discussed for FIG. 1. Once finished, the user may press or manipulate the OK button 280 to save the current settings and exit out of the trip management screen of the trip management system 200. In certain embodiments, the trip management screen of the trip management system 200 may additionally allow a user to delete or rename previously stored categories, delete or rename previously stored trip data, or otherwise manipulate the associations between various categories and trip data stored in the memory.

Figure 3:
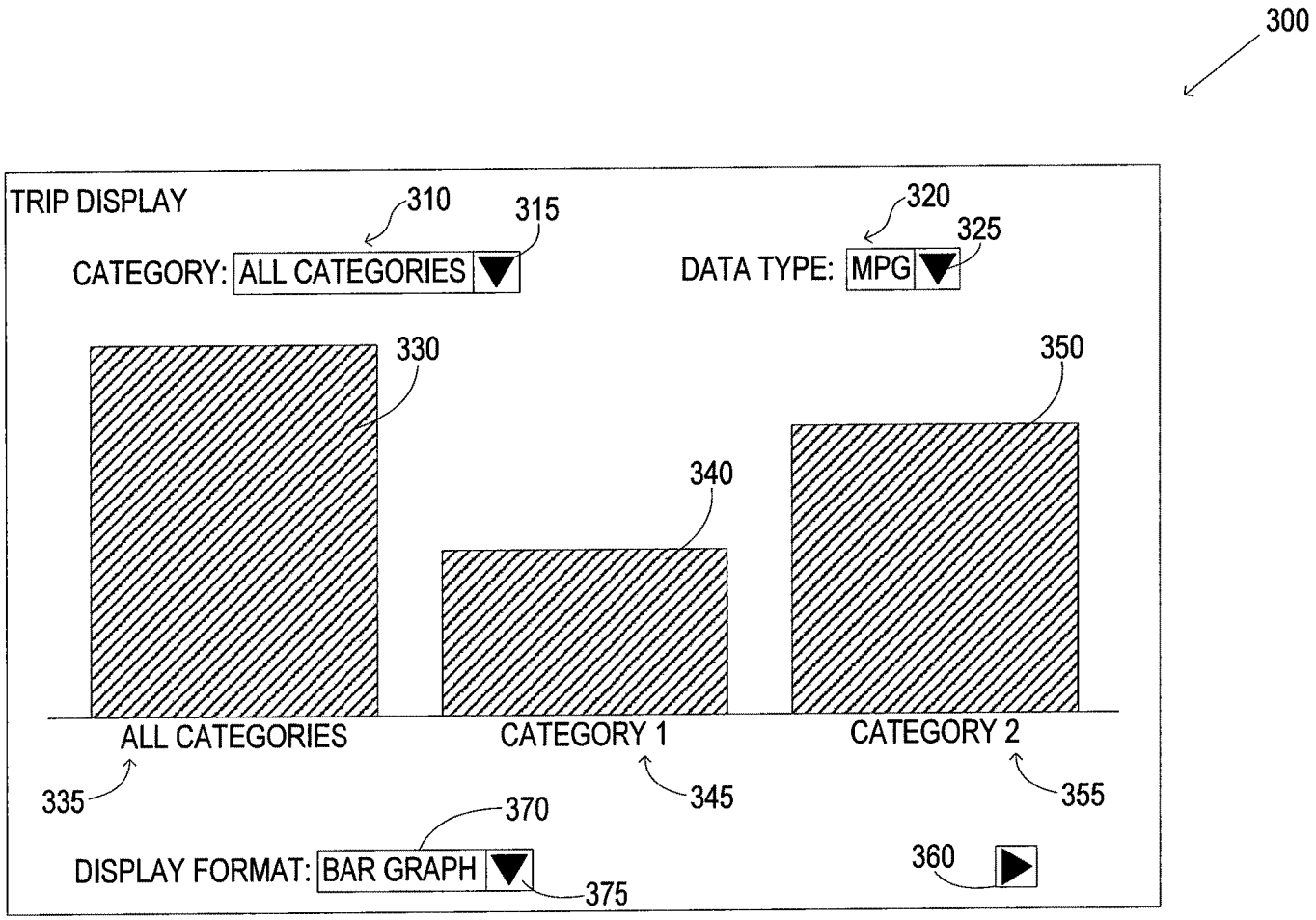
FIG. 3 is display user-interface screen of a trip management system for a vehicle for displaying trip data according to an embodiment of the present invention.

FIG. 3 shows one embodiment of a trip display screen of a trip management system 300 of a vehicle for displaying trip data. The trip display screen may be displayed on a display within a cabin of the vehicle for allowing a user of the vehicle to view trip data of the vehicle. The trip management system 300 may be the same or similar to the trip management systems previously described for FIGS. 1 and 2. By interfacing with trip data previously stored and associated with various categories of the trip management system 300 (see, for example, FIG. 2), the trip management system 300 may provide a visual indication to the user of the vehicle of a variety of travel or performance characteristics for the vehicle.

The trip display screen of the trip management system 300 includes a category selection box 310 and an associated drop-down button 315. The user of the vehicle may press or manipulate the drop-down button 315 to see a list of some or all of the previously stored categories for trip data of the trip management system 300. A scroll bar may be utilized for displaying stored categories that exceed the available screen space of the list. In addition, in one embodiment, a grouping of all categories together (e.g., "All Categories") may be selected for viewing overall travel characteristics for the vehicle without being specifically narrowed to a particular category. The display screen also includes a data type selection box 320 and an associated drop-down button 325. The user of the vehicle may press or manipulate the drop-down button 325 to see a list of some or all of the available types of data or information they may receive visual feedback on (e.g., miles per gallon, speed, time of travel, etc). Similar to the above, a scroll bar may be utilized for displaying data types that exceed the available screen space of the list. The trip management system 300 looks up trip data corresponding to the category selected in the category selection box 310 and the data type selected in the data type selection box 320 for display to the user, as discussed below. This trip data may be trip data acquired directly during travel (e.g., step 115 of FIG. 1) or may be calculated or statistical data (e.g., average fuel efficiency) determined from such acquired data (e.g., step 125 of FIG. 1).

For example, if the user selects "All Categories" to be displayed in the category selection box 310 and selects fuel efficiency (e.g. "MPG") information in the data type selection box 320, a first graph 330 showing fuel efficiency data for "All Categories" 335 combined is displayed. In addition, fuel efficiency information for each stored category may also be displayed separately when choosing "All Categories." For example, graph 340 corresponds to fuel efficiency data for "Category 1" 345 and graph 350 corresponds to fuel efficiency information for "Category 2" 355. A next page button 360 allows a user to page across multiple display pages if more categories or data exist than can fit on one display screen. The user of the vehicle can also select the desired display or viewing format for the graphs (330, 340, 350) by pressing or manipulating the drop-down button 375 associated with a display or viewing format selection box 370. Any of a variety of display or viewing formats may be chosen, for example, bar graphs, line graphs, numerals, pie charts, etc. In certain embodiments, trip data that does not exceed a predetermined threshold for trip length (e.g., a trip less than 0.01 km) may be ignored or disregarded and thus not shown or utilized for trip data statistics or calculations. For example, if fuel economy data or statistics would misrepresent or would inaccurately demonstrate vehicle fuel efficiency if trips of less than 0.01 km were factored in, data associated with such trips may be ignored by the trip management system 300 and not displayed or otherwise utilized.

Figure 4:
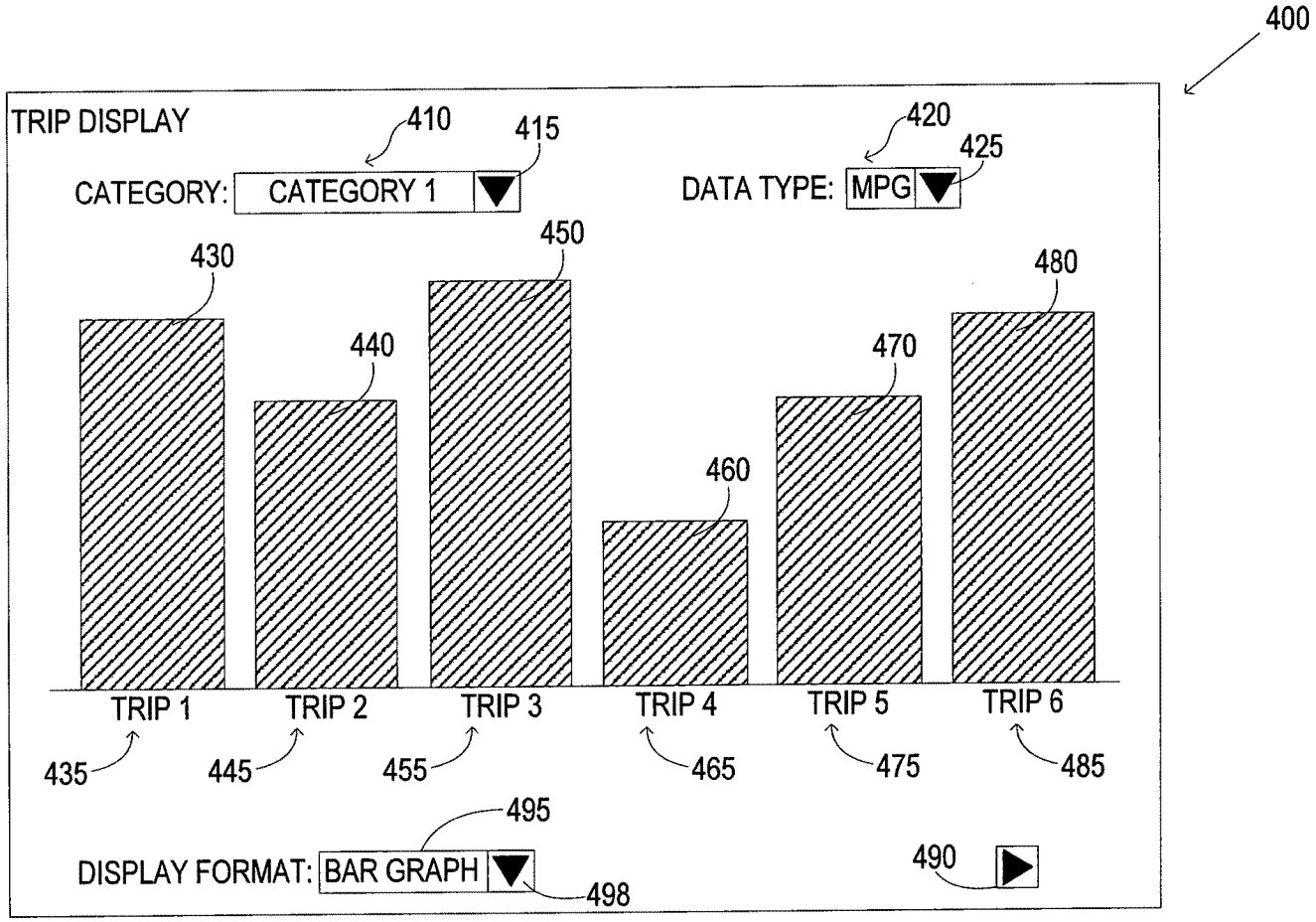
FIG. 4 is a display user-interface screen of a trip management system for a vehicle for displaying trip data according to an embodiment of the present invention.

FIG. 4 shows a trip display screen of a trip management system 400 of a vehicle for displaying trip data. The trip display screen may be displayed on a display within a cabin of the vehicle for allowing a user of the vehicle to categorize and name trip data of the vehicle. The trip management system 400 may be the same or similar to the trip management systems previously described for FIGS. 1-3. The trip display screen of the trip management system 400 includes a category selection box 410 and associated drop-down button 415, a data type selection box 420 and associated drop-down button 425, a next page button 490, and a display format selection box 495 and associated drop-down button 498, the same or similar as previously described for FIG. 3.

FIG. 4, however, shows the trip display screen of the trip management system 400 when the user has selected a particular category for viewing and thus indicates particular trip data within that category on the display rather than viewing overall category data (see, for example, FIG. 3). For example, if the user selects "Category 1" in the category selection box 410 and fuel efficiency (e.g., "MPG") in the data type entry box 420, each of the trip data sets associated with Category 1 in the trip management system 400 have their fuel efficiency information displayed to the user. The display screen of the trip management system 400 thus displays a graph 430 corresponding to fuel efficiency information for "Trip 1" 435 assigned to Category 1, a graph 440 corresponding to fuel efficiency information for "Trip 2" 445 assigned to Category 1, a graph 450 corresponding to fuel efficiency information for "Trip 3" 455 assigned to Category 1, a graph 460 corresponding to fuel efficiency information for "Trip 4" 465 assigned to Category 1, a graph 470 corresponding to fuel efficiency information for "Trip 5" 475 assigned to Category 1 and a graph 480 corresponding to fuel efficiency information for "Trip 6" 485 assigned to Category 1. The next page button 490 allows a user to page through multiple display screens if more trip information or data exists for the selected category than can be shown on a single display screen.

Figure 5:
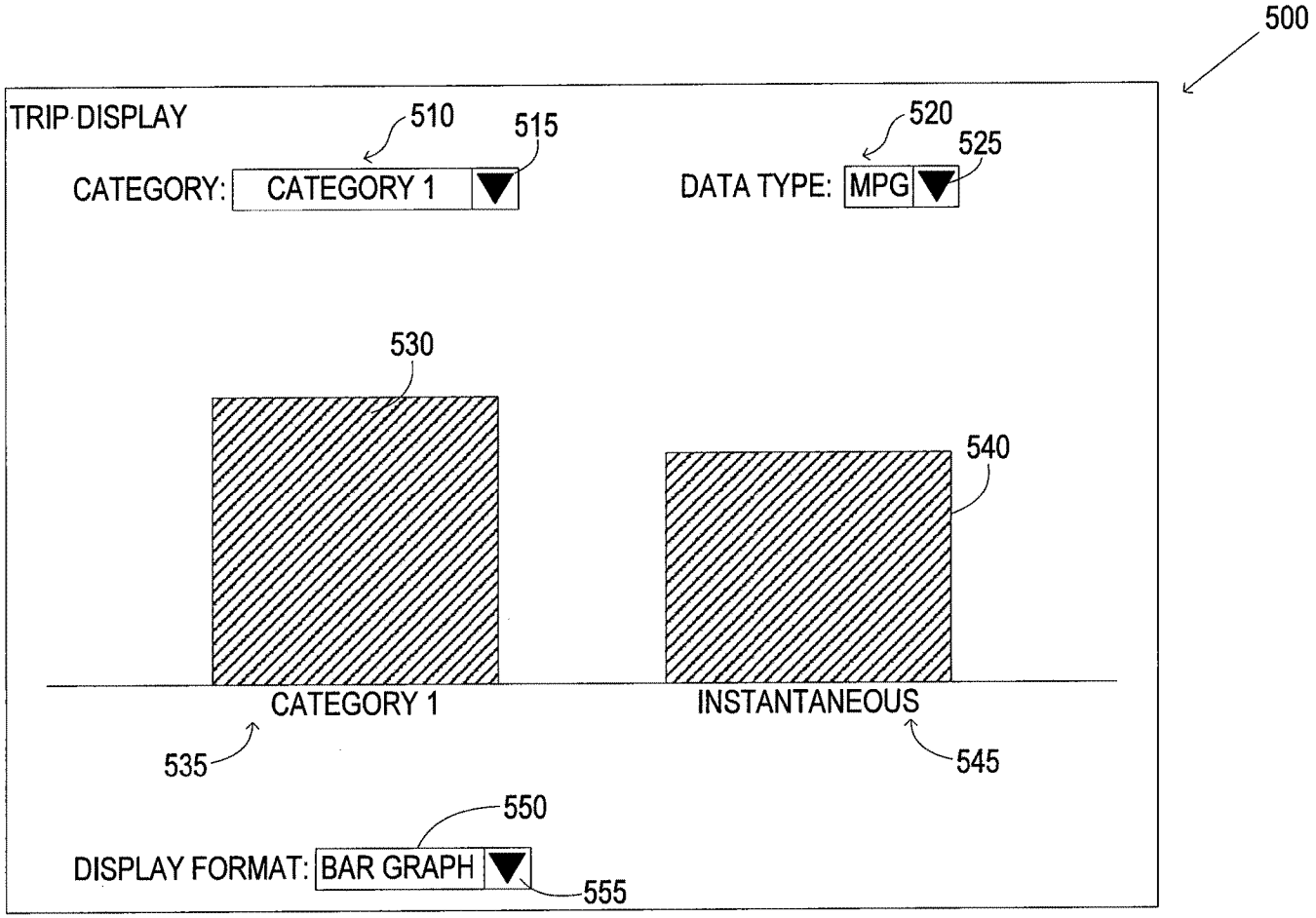
FIG. 5 is a display user-interface screen of a trip management system for a vehicle for displaying instantaneous trip data with categorized trip data according to an embodiment of the present invention.

FIG. 5 shows a trip display screen of a trip management system 500 of a vehicle for displaying instantaneous trip data adjacent to categorized trip data. The trip display screen may be displayed on a display within a cabin of the vehicle. The trip management system 500 may be the same or similar to the trip management systems previously described for FIGS. 1-4. The trip display screen of the trip management system 500 includes a category selection box 510 and associated drop-down button 515, a data type selection box 520 and associated drop-down button 525 and a display format selection box 550 and associated drop-down button 555, the same or similar as previously described for FIG. 3 or 4.

FIG. 5, however, shows the trip display screen of the trip management system 500 when the user has selected a data type for a particular category and in a mode or with a setting configured to display the category data side-by-side with an instantaneous representation of the data type. For example, if the user selects "Category 1" in the category selection box 510 and fuel efficiency (e.g., "MPG") in the data type entry box 520, a graph 530 corresponding to fuel efficiency information for "Category 1" 535 is shown on the screen of the trip management system 500. In addition, a graph 540 corresponding to instantaneous fuel efficiency information 545 for the vehicle is shown on the screen adjacent to the graph 530. Thus, a user may receive real-time feedback on how their current driving characteristics match with previously stored trip data. The user may view instantaneous data for a variety of data types and adjacent to a particular category or a combination (e.g., an average) of multiple categories together. In an alternative embodiment, the user may choose to place instantaneous data adjacent to particular trip data rather than for a category as a whole. In yet another embodiment, the instantaneous representation of the data type may be a plurality of graphs or visual indicators (e.g., an average fuel efficiency updated at a predetermined rate, such as every minute) and located adjacent to a stored representation of the data type for the current trip of the vehicle overall (e.g., an average fuel efficiency for the overall current trip). In this way, the user may receive simultaneous indicators of a current driving characteristic versus the characteristic for the current trip overall.

Steps described for one of the embodiments above may additionally or alternatively be incorporated into any of the other embodiments. Various steps may be performed or executed in different orders or removed entirely in an alternative embodiment. An alternative embodiment may add new steps. The various illustrative logical blocks, modules, and algorithm steps described in connection with the examples disclosed herein may be implemented as electronic hardware, computer software, or combinations of both. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the disclosed apparatus and methods. Likewise, management screens or display screens may be configured or oriented differently from the specific embodiments shown above in order to perform the same, similar, different, reduced, or additional functions or features.

The steps of a method or algorithm described in connection with the examples disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an Application Specific Integrated Circuit (ASIC). The ASIC may reside in a wireless modem. In the alternative, the processor and the storage medium may reside as discrete components in the wireless modem.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A method for managing data of a vehicle, the method comprising:

acquiring, by a processor, first trip data that was measured from a start location of a first trip until an end location of the first trip, and second trip data that was measured from a start location of a second trip until an end location of the second trip;

automatically categorizing, by the processor, the first trip data that was measured from the start location of the first trip until the end location of the first trip into a respective category of a plurality of categories, each category of the plurality of categories having a plurality of trips, the plurality of trips having a same trip parameter, the same trip parameter corresponding to at least one of a distance traveled, a predetermined amount of time measured from a start location to an end location or a predetermined vehicle speed;

determining, by the processor, a first filename for the first trip data;

determining, by the processor, that the second trip data corresponds to the respective category;

determining, by the processor, a second filename for the second trip data;

storing, in a memory coupled to the processor, a first association of the first trip data, the respective category and the first filename;

storing, in the memory, a second association of the second trip data, the respective category and the second filename; and displaying, on a display coupled to the processor, information corresponding to at least a portion of the first trip data or the second trip data based on a selection of the respective category and at least one of the first association or the second association.

2. The method of claim 1, further comprising the step of calculating, by the processor, the information based on at least the portion of the first trip data or the second trip data.

3. The method of claim 2, wherein the information that is based on at least the portion of the first trip data or the second trip data is fuel efficiency information for the vehicle.

4. The method of claim 1, further comprising:

determining, by the processor, that the second trip has concluded when a desired end-of-trip parameter has been met for the second trip; and stopping, by the processor, the acquiring of the second trip data when the second trip has been determined to be concluded.

5. The method of claim 1, further comprising determining, by the processor, a viewing format for the information corresponding to at least the portion of the first trip data or the second trip data and wherein displaying the information further includes displaying the information in the viewing format.

6. The method of claim 5, wherein the viewing format includes at least one of a bar graph, a line graph, a numeral or a pie chart.

7. The method of claim 1, further comprising calculating, by the processor, an average fuel efficiency based on the first trip data and the second trip data, wherein the information displayed on the display is the average fuel efficiency.

8. The method of claim 7, wherein calculating the average fuel efficiency includes at least one of:

disregarding the first trip data if a distance of the first trip is less than a predetermined distance, or disregarding the second trip data if a distance of the second trip is less than the predetermined distance.

9. The method of claim 1, further comprising the displaying, on the display, an instantaneous data value corresponding to the vehicle adjacent to the information that is based on at least the portion of the first trip data or the second trip data.

10. A method for managing data corresponding to a vehicle, the method comprising:

receiving, by a processor, first trip data that was measured during a first trip of the vehicle until a desired end-of-trip parameter has been met for the first trip, and a second trip data that was measured during a second trip of the vehicle until the desired end-of-trip parameter has been met for the second trip;

storing, in a memory coupled to the processor, the first trip data and the second trip data;

automatically categorizing, by the processor, the first trip data that was measured during the first trip into a respective category of a plurality of categories, each category of the plurality of categories having a s plurality of trips, the plurality of trips having a same trip parameter, the same trip parameter corresponding to at least one of a distance traveled, a redetermined amount of time measured for a trip or a predetermined vehicle seed;

associating, by the processor, a first filename with the first trip data;

determining, by the processor, that the second trip data corresponds to the respective category;

associating, by the processor, a second filename with the second trip data;

determining, by the processor, output data based on at least a portion of the first trip data or the second trip data; and displaying, on a display coupled to the processor, the output data.

11. The method of claim 10, further comprising calculating, by the processor, a statistic based on at least the portion of the first trip data or the second trip data, wherein the output data includes the statistic.

12. The method of claim 10, further comprising receiving, by an input device, data indicating a desired portion of the first trip data or the second trip data to be displayed, wherein determining the output data is further based on the data indicating the desired portion.

13. The method of claim 10, further comprising displaying, on the display, an instantaneous data value corresponding to the vehicle adjacent to the output data.

14. The method of claim 10, further comprising:

receiving, from the input device, data requesting that the respective category be created, receiving, by the processor, the data requesting that the respective category be created, and adding, by the processor, the respective category to the list of available categories in response to receiving the data requesting that the respective category be created.

15. The method of claim 10, further comprising automatically creating, by the processor, the first filename.

16. A system for management of trip data for a vehicle, comprising:

an input device configured to receive data indicating a desired end-of-trip parameter;

a processor coupled to the input device and configured to:

receive first trip data that was measured from a start location of a first trip until the desired end-of-trip parameter has been met for the first trip and second trip data that was measured from a start location of the second trip until the desired end-of-trip parameter has been met for the second trip, automatically categorize the first trip data that was measured from the start location of the first trip into a respective category of a plurality of categories, each category of the plurality of categories having a plurality of trips, the plurality of trips having a same trip parameter, the same trip parameter corresponding to at least one of a distance traveled, a predetermined amount of time measured from the start location to desired end-of-trip parameter or a predetermined vehicle speed, assign the category and a first filename to the first trip data, assign the category and a second filename to the second trip data, and calculate output data based on at least one of the first trip data or the second trip data;

a memory coupled to the processor and configured to store the first trip data and the second trip data; and a display coupled to the processor and configured to display the output data.

17. The system of claim 16, wherein the input device is further configured to receive the first filename.

18. The system of claim 16, wherein the display is a liquid crystal display and is positioned in a dash of an interior of the vehicle.

19. The system of claim 16, wherein the display is configured to display instantaneous data relating to the vehicle adjacent to the output data.

* * * * *